United States Patent [19]

Evans

[11] 4,386,669

[45] Jun. 7, 1983

[54] DRILL BIT WITH YIELDING SUPPORT AND FORCE APPLYING STRUCTURE FOR ABRASION CUTTING ELEMENTS

[76] Inventor: Robert F. Evans, 631 Honeywood La., La Habra, Calif. 90631

[21] Appl. No.: 214,216

[22] Filed: Dec. 8, 1980

[51] Int. Cl.[3] ..... E21B 10/14; E21B 10/34

[52] U.S. Cl. ..... 175/269; 175/381; 175/329; 175/336

[58] Field of Search ..... 175/65, 327, 342, 381, 175/382, 403, 404, 405, 402, 330, 267-269, 336

[56] References Cited

U.S. PATENT DOCUMENTS

| | | | |
|---|---|---|---|
| 1,394,769 | 10/1921 | Sorensen | 175/381 |
| 1,406,185 | 2/1922 | Hansen | 175/403 |
| 1,839,767 | 1/1932 | Lopez | 175/267 |
| 2,054,277 | 9/1936 | Wright | 175/403 |
| 2,149,798 | 3/1939 | Starkey | 175/412 |
| 2,198,849 | 4/1940 | Waxler | 175/381 |
| 2,262,001 | 11/1941 | Hokanson | 175/412 |
| 2,317,010 | 4/1943 | Wingard | 255/1.6 |
| 2,499,916 | 3/1950 | Harris | 255/73 |
| 2,774,570 | 12/1956 | Cunningham | 255/347 |
| 2,830,795 | 4/1958 | Center, Jr. | 175/403 |
| 2,990,025 | 7/1961 | Talbert et al. | 175/375 |
| 3,055,443 | 9/1962 | Edwards | 175/330 |
| 3,174,564 | 3/1965 | Morlan | 175/330 |
| 3,239,431 | 3/1966 | Knapp | 175/331 |
| 3,401,759 | 9/1968 | White | 175/341 |
| 3,424,258 | 1/1969 | Nakayama | 175/333 |
| 3,442,342 | 5/1969 | McElya et al. | 175/374 |
| 3,727,705 | 4/1973 | Newman | 175/374 |
| 3,779,323 | 12/1973 | Horten et al. | 175/381 |
| 3,982,596 | 9/1976 | Vetter | 175/412 |
| 4,006,788 | 2/1977 | Garner | 175/330 |
| 4,067,406 | 1/1978 | Garner | 175/341 |
| 4,140,189 | 2/1979 | Garner | 175/329 |
| 4,148,368 | 4/1979 | Evans | 175/329 |
| 4,203,496 | 5/1980 | Baker et al. | 175/329 |
| 4,262,758 | 4/1981 | Evans | 175/267 |

FOREIGN PATENT DOCUMENTS

| | | | |
|---|---|---|---|
| 2839868 | 4/1979 | Fed. Rep. of Germany | 175/267 |
| 625776 | 12/1962 | France | 175/403 |
| 548701 | 2/1977 | U.S.S.R. | 175/403 |
| 622961 | 7/1978 | U.S.S.R. | 175/403 |

OTHER PUBLICATIONS

"Rock Mechanics Symposium", *The American Society of Mechanical Engineers,* Nov. 11, 1973, AMD-vol. 3.

"Cutting Action of a Single Diamond Under Simulated Borehole Conditions", by N. E. Garner, *Journal of Petroleum Technology,* Jul. 1967, p. 937.

"Understanding the Fundamentals of Wear", by Bayer, *Machine Design,* p. 63.

*Primary Examiner*—Leppink James A.
*Assistant Examiner*—Hoang C. Dang
*Attorney, Agent, or Firm*—John R. Ley

[57] ABSTRACT

Abrasion cutting elements of a rotary drill bit are operatively connected to the bit body structure by means for yieldably supporting the abrasion cutting elements and for forcing them into a continuous drag mode of cutting contact with the earth formation. The drill bit may also employ compression or indentor cutting elements operatively attached in fixed operative positions. The yieldably supporting and force applying means may be hydraulically controlled by drilling fluid pressure and the cutting force applied on the abrasion cutting elements can be established independently of the axial cutting force transferred from the drill string and drill bit to the indentor cutting elements. Optimum performance of both the abrasion and indentor types of cutting elements is secured. The abrasion cutting elements are preferably retained for contacting and cutting the gage corner material. In drag bit applications, the means for yieldably supporting and applying force to the abrasion cutting elements may include a plurality of concentric removably retained sleeve members, each of which includes at least one ribbon spring leaf portion extending from the bottom of the sleeve member to support the abrasion cutting elements.

14 Claims, 7 Drawing Figures

DRILL BIT WITH YIELDING SUPPORT AND FORCE APPLYING STRUCTURE FOR ABRASION CUTTING ELEMENTS

The present invention pertains to rotary drill bits employed for cutting or drilling well bores. More particularly, the present invention pertains to a new and improved arrangement for use with rotary drill bits of either the cutting wheel type or the drag type, in which abrasion cutting elements are advantageously and operatively connected to the drill bit by means of a yieldable support and force applying structure.

The two basic methods for drilling or attacking earth formations are an indentor method and a drag method. The indentor method basically involves the application of percussion or compression forces to the earth formation by compression or indentor cutting elements. The relatively high compression forces crush, chip or fracture the earth formation. The drag method of attack involves the use of abrasion cutting elements. The abrasion cutting elements basically apply a shear force to the earth formation to slice or abrade away layers of the earth formation.

Due to the significant differences in cutting action, compression cutting elements typically possess significantly different physical characteristics than abrasion cutting elements. Compression cutting elements are very effective in withstanding high compressive forces and exhibit excellent wear resistance characteristics in response to the high compression forces. The well known tungsten carbide inserts attached to the rotary cone wheels of well known multi-cone drill bits are examples of compression or indentor cutting elements which operate primarily in an indentor mode of attack. Like most other types of compression cutting elements, tungsten carbide inserts are relatively brittle in response to shear forces and are therefore susceptible to rapid chipping and fracture when operated in a drag or shear mode of cutting. To avoid concentrations of high shear forces, tungsten carbide inserts typically have generously rounded corners and edges. The rounded edges even further diminish the ability to be effective in a drag mode of cutting. The typical abrasion cutting element is formed of natural or synthetic diamond material. The diamond material exhibits substantial strength and wear resistance in response to shear forces, but high forces on the abrasion cutting areas perpendicular to the direction of abrasion cutting movement result in rapid failure of the diamond material after relatively short periods of use. Typical synthetic material abrasion cutting elements are disclosed in U.S. Pat. No. 4,156,329 and are commercially available under the trademark STRATAPAX.

In the past, drill bits have been devised which employ both abrasion and compression cutting elements. These drill bits typically take the form of a multi-cone wheel bit having tungsten carbide inserts attached to the cone wheels. The abrasion cutting elements are rigidly connected to rigid support elements extending from the body of the drill bit and are positioned to cut the same area of the earth formation contacted by the tungsten carbide inserts or, as is more common, cut a different area of the earth formation than that contacted by the tungsten carbide inserts. Use of these types of bits has shown that the axial load applied to the abrasion cutting elements, i.e. drill bit weight, must be limited to a value less than that axial load required to render the tungsten carbide inserts most effective in a crushing, chipping mode; otherwise the abrasion cutting elements experience premature failure as a result of excessive loads applied perpendicularly to the direction of abrasion cutting attack. Stated differently, the axial bit load required for optimum performance by indentor cutting elements such as tungsten carbide inserts is so sufficiently great as to result in premature failure of the abrasion cutting elements.

Although arrangements have been devised to restrict the compression forces applied to the abrasion cutting elements, such arrangements typically have compromised the optimum performance of both the abrasion and compression cutting elements. It is to the dilemma of attempting to secure reasonably optimum performance from both compression and abrasion cutting elements operatively attached to the same rotary drill bit that the present invention is directed.

Abrasion cutting elements are also subject to rapid deterioration and wear as a result of large but intermittent compressive shock forces. This holds true whether the abrasion cutting elements are exclusively used on the bit, as in drag bits, or whether the abrasion cutting elements are used in combination with compression cutting elements, as in the combination bit structures described above. Intermittent shock forces in a well drilling environment can result from a number of widely diverse causes, most of which cannot be prevented. Shock forces from mechanical vibration of the drill string and other drilling elements are common. The geological earth formation may fracture, break or cut with different resistive forces from one point to the next leaving uneven protruding areas which apply highly concentrated forces to limited areas of the cutting elements. Differences in the hardness and therefore the wear resistance of the geological earth formations occur from point to point. All of these sources of intermittent shock forces possess the capability for significantly reducing the usable lifetime of abrasion cutting elements. It is also to the problem of premature wear to abrasion cutting elements as a result of essentially uncontrollable high intermittent shock forces that this invention is also directed.

SUMMARY

One of the primary objectives of the present invention is to provide a rotary drill bit utilizing abrasion cutting elements which are substantially protected from high intermittent overloading and shock forces, thereby extending the usable lifetime of such cutting elements. In accordance with this aspect of the present invention the abrasion cutting elements are connected to the body structure of the drill bit by means which yield slightly under the application of intermittent axial shock forces but which apply ample support and cutting contact pressure between the abrasion cutting elements and the earth formation. One particularly advantageous form of the invention is a plurality of concentric sleeve members retained, preferably removably, to the body structure of a bit. Spiral slots are formed through the wall of each sleeve member and thereby define extended ribbon portions of the sleeve member to which the abrasion cutting elements are connected at the lower ends. Spring temper characteristics are created in the ribbon portions. The ribbon portions thereby force the abrasion cutting elements into a substantial abrading contact with the earth formation but yield in response to high intermittent shock loads. With a plurality of spaced concentric sleeve members, each having one or more of the ribbon portions, localized applications of shock forces affect only those abrasion cutting elements and ribbon portions in operative contact with that shock-applying area while the remaining cutting elements at the face of the earth formation being drilled are relatively uneffected. The effects of the intermittent shock forces on the drill bit as a whole are substantially reduced, the usable lifetime of the abrasion cutting elements is extended, and the drill bit may be more readily repaired or rebuilt due to the separate and removable characteristics of the sleeve members.

Another significant objective of the present invention is to provide a new and improved manner and arrangement for employing abrasion cutting elements in combination with compression or indentor cutting elements in a rotary drill bit and to obtain optimum performance from both types of cutting elements. In accordance with this aspect of the present invention, the abrasion cutting elements are operatively attached to the body structure of the drill bit by yieldably supporting and force applying means, and the compression cutting elements are operatively connected to the body structure in operationally fixed positions, such as on the cone wheels. The yieldably supporting and force applying means operatively applies a predetermined amount of force from the abrasion cutting element to the earth formation and that force can be limited to an amount less than and substantially independent of the axial cutting force applied between the compression cutting elements and the earth formation as a result of weight on the bit. Since the cutting force on each type of cutting element can be independently controlled, optimum performance and longevity of both types of cutting elements can be secured without sacrificing maximum cutting effectiveness of one or both types of cutting elements. The abrasion cutting element is operatively connected to the body structure of the drill bit to move axially forward and radially outward from an inwardly biased inoperative position to an extended operative position. The yieldably supporting and force applying means is preferably hydraulic, and the extension movement and the contact force of the abrasion cutting elements on the earth formation can be controlled by the application and regulation of hydraulic pressure. The source of hydraulic force is preferably the pressure of the drilling fluid within the conventional drilling fluid passageway of the drill string. The abrasion cutting elements are protected in the inoperative position until the drilling fluid in the drilling fluid passageway is pressurized when drilling commences. Damage due to contact with the sidewall of the well bore or its casing is therefore avoided when the abrasion cutting element is in its retracted nonoperative position during times that the drill bit is removed from or inserted in the well bore, during "tripping".

It is another significant objective of the present invention to increase the performance of a relatively compact rotary drill bit of the type employing rotating cutter wheels to which compression cutting elements are operatively attached. In accordance with this aspect of the present invention abrasion cutting elements are also operatively connected to the drill bit, and the abrasion cutting elements are operatively located to contact the gage corner portion of the earth formation as the well bore is drilled. The gage corner portion of the earth formation is normally cut by a heel row of indentor or compression cutting elements attached to the cutter wheels. Particularly with offset cutter wheel configurations, the majority of the cutting effect on the gage corner is primarily accomplished through a drag mode of cutting. Of course, the indentor cutting elements of the heel row are not optimally effective in the drag mode of cutting. By positioning the abrasion cutting elements to also cut the gage corner, the gage corner is more effectively removed without complete reliance on the cutting action of the indentor cutting elements of the heel row. Since the abrasion cutting elements assist the heel row of indentor cutting elements in removing the gage corner material, the penetration rate of the well bore is increased, the longevity of the heel row of indentor cutting elements is extended, and the tendency for drilling an undergage well bore due to rapid wear and deterioration of the heel row of indentor cutting elements is minimized. In addition, the uniform application of the abrasion cutting elements to the gage corner material avoids or minimizes natural imbalance situations created by sloping geological formations of differing hardness and hence hole deviations. The well bore therefore is drilled in a straighter manner.

The nature and details of the present invention can be more completely understood by reference to the following claims and the description of the preferred embodiments taken in conjunction with the drawings.

DRAWINGS

PREFERRED EMBODIMENTS

Figure 1:
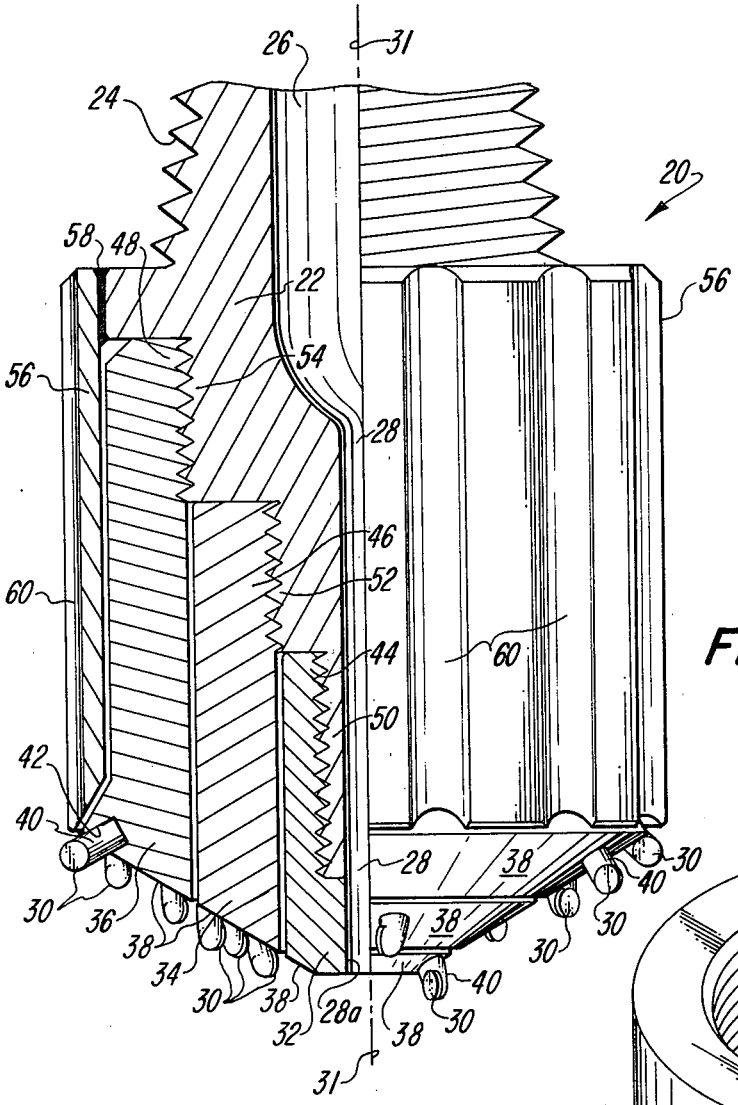
FIG. 1 is a side elevational view of a rotary drag bit embodying one form of the present invention, with the left-hand half vertically sectioned along an axis thereof to illustrate means for yieldably supporting and applying force to abrasion cutting elements thereof.
Figure 2:
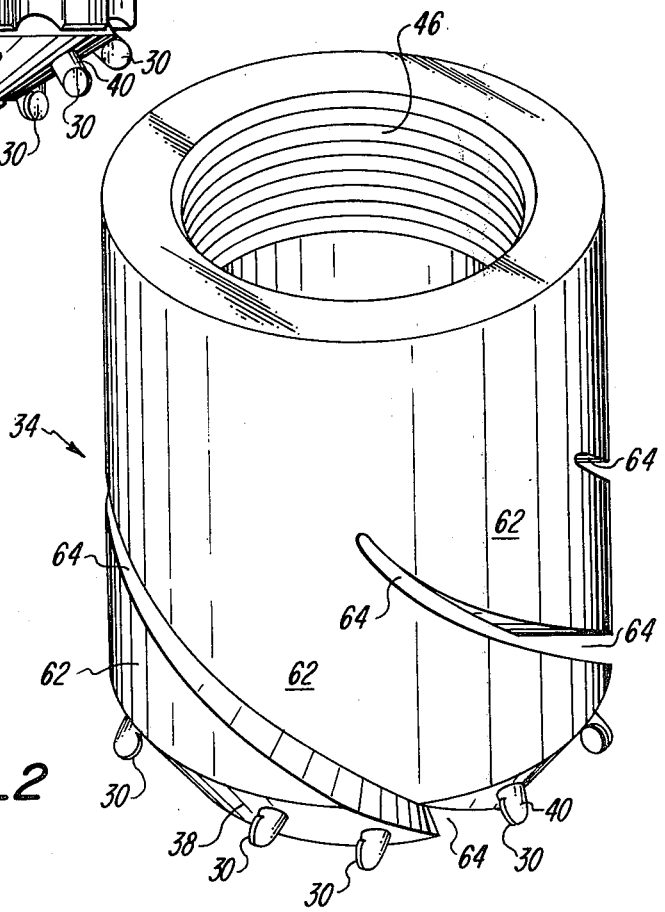
FIG. 2 is a perspective view of a sleeve element of the drill bit illustrated in FIG. 1.

An embodiment of the present invention shown in FIGS. 1 and 2 is particularly useful in conjunction with a rotary drag bit 20. The drag bit 20 comprises a main body structure 22 having a threaded end 24. Lengths of drill pipe (not shown) comprising the drill string are threadably connected to the bit 20 at the threaded end 24. A drilling fluid passageway 26 extends axially into the body structure 22. A reduced size axial passageway 28 extends from the drilling fluid passageway 26 to the lowermost end of the bit 20. The passageway 28 defines a drilling fluid expulsion nozzle through which pressurized drilling fluid is expelled in a jet on the drill face of the well bore cut by the bit 20. Of course, the expelled drilling fluid lifts the particle cuttings removed by the drill bit and transports them out of the well bore through the annulus between the drill string and the sidewalls of the well bore.

A plurality of abrasion cutting elements 30 are operatively connected from the bit 20. The abrasion cutting elements 30 contact and cut the earth formation in a shearing or abrading circular motion path when the bit 20 is rotated about its axis 31 by rotating the drill string. The abrasion cutting elements 30 are preferably of the natural or synthetic or diamond material type. Diamond materials cutting elements are highly abrasive and highly resistive to wear in a shear cutting mode. One example of a well known synthetic diamond material abrasion cutting element is disclosed in U.S. Pat. No. 4,156,329. Synthetic cutting elements are commercially available from General Electric under the trademark STRATAPAX.

A plurality of different diameter cylindrical sleeve members, e.g. 32, 34 and 36, are operatively connected to the body structure 22 at different radially outward spaced positions concentric about the bit axis 31. The abrasion cutting elements 30 are rigidly connected to extend from a lower surface 38 of each of the concentric sleeve members. The abrasion cutting elements are connected to the sleeve members in the typical manner. U.S. Pat. No. 4,006,788 describes a typical manner of attachment of the abrasion cutting elements. In general however, the abrasion cutting element 30 is attached to a slug 40, and the slug 40 is bonded within a correspondingly-shaped opening 42 extending into each sleeve member from its lower surface 38. As is shown in FIG. 1, the radially inwardmost sleeve member 32 may include a passageway 28*a* formed therethrough for the purpose of extending the passageway 28 in the body structure and for the purpose of defining a nozzle orifice for the expulsion of the pressurized drilling fluid.

Preferably, each of the sleeve members, e.g. 32, 34 and 36 is removably connected to the body structure 22. In the embodiment shown in FIG. 1, upper threaded ends 44, 46 and 48 of the sleeve members 32, 34 and 36 are threaded onto threaded stepped shoulders 50, 52 and 54 of the body structure 22, respectively, to thereby rigidly connect the upper ends of the sleeve members to the bit body structure. The threaded stepped shoulders 50, 52 and 54 are positioned at different radial locations which correspond with the upper threaded ends of each sleeve member according to its diameter. Similarly, the axial location of the threaded stepped shoulders 50, 52 and 54 is determined in accordance with the length of each sleeve member between the lower surface 38 and its upper threaded end, to position the lower surfaces 38 and cutting elements 30 in a desired cutting configuration and profile. In addition to the threaded connection means for removably attaching each sleeve member to the bit body structure, other types of sleeve members can be welded or otherwise bonded to the stepped shoulders. Repair, rebuilding and replacement of the sleeve members and their attached abrasion cutting elements 30 is facilitated by removably connecting the sleeve members to the body structure. Convenient access to those parts in need of repair or replacement is achieved by removing one or more of the sleeve members. New sleeve members with fresh cutting elements can be readily attached to the bit body, rather than discarding the whole bit if only a portion of its elements have failed. Replacement of the abrasion cutting elements and their attachment slugs is more easily accomplished with the sleeve members removed from the drill bit.

An outer cover and protection sleeve 56 is also attached at the radial outward position of the body structure 22. Preferably, the protection sleeve 56 is integral with the bit structure 22 or is bonded thereto by a weld at 58. A plurality of axially extending grooves 60 are formed in the outer surface of the protection sleeve 56. The grooves 60 define upward extending passageways through which the drilling fluid and the particle cuttings are carried by the drilling fluid flow upward away from the drill face of the well bore. The protection sleeve 56 also protects the radially outermost sleeve member 36 from contacting the sidewall of the well bore and from the influences of the drilling fluid flowing therepast.

In order to operatively support each of the abrasion cutting elements 30 from the drill bit 20 in a manner which allows the abrasion cutting element to yield axially under the application of shock loads and locally concentrated forces, but which will apply optimum force to the abrasion cutting elements to achieve the best cutting effects, the lowermost portion of each sleeve member is defined into a plurality of separate ribbon members 62. As is shown in FIG. 2, the lower portion of the sleeve member 34 is defined into the ribbon portions 62 by helical slots 64 formed completely through the sidewall of the sleeve member. As a result, each of the ribbon portions 62 is generally helically extending and separate from one another, but the whole of the ribbon portions still retains the general configuration of a cylindrical sleeve. After forming the ribbon portions 62, the metal material, typically steel, of each sleeve member is subjected to known metallurgical treatments which create a spring temper in each of the ribbon portions 62. Each of the ribbon portions thereby take on the characteristics of a helically extending leaf spring cantileverly supported at its upper end from the upper portion of the sleeve member. Of course, the abrasion cutting elements 30 are operatively connected to the lower surface 38 of each ribbon portion 62 between the slots 64.

The application of weight to the drill bit 20 is transferred through the ribbon portions 62 to the abrasion cutting elements 30. The cutting elements 30 are forced into the earth formation being drilled. Under the influence of intermittent shock forces or localized concentrated areas of force, one or more of the ribbon portions 62 of one or more of the sleeve members, 32, 34 or 36, will deflect under the influence of the force and prevent or significantly reduce the potentially damaging effects of intermittent or locally concentrated forces on the cutting elements 30 in a direction perpendicular to their direction of abrasion cutting attack. Under normal cutting conditions the ribbon portions 32 deflect until the predetermined desired operational force or weight on the drill bit is applied to the abrasion cutting elements. In this manner, the optimum cutting force from the abrasion cutting elements to the earth formation is maintained while protecting against intermittent shock and locally concentrated axial forces.

Figure 3:
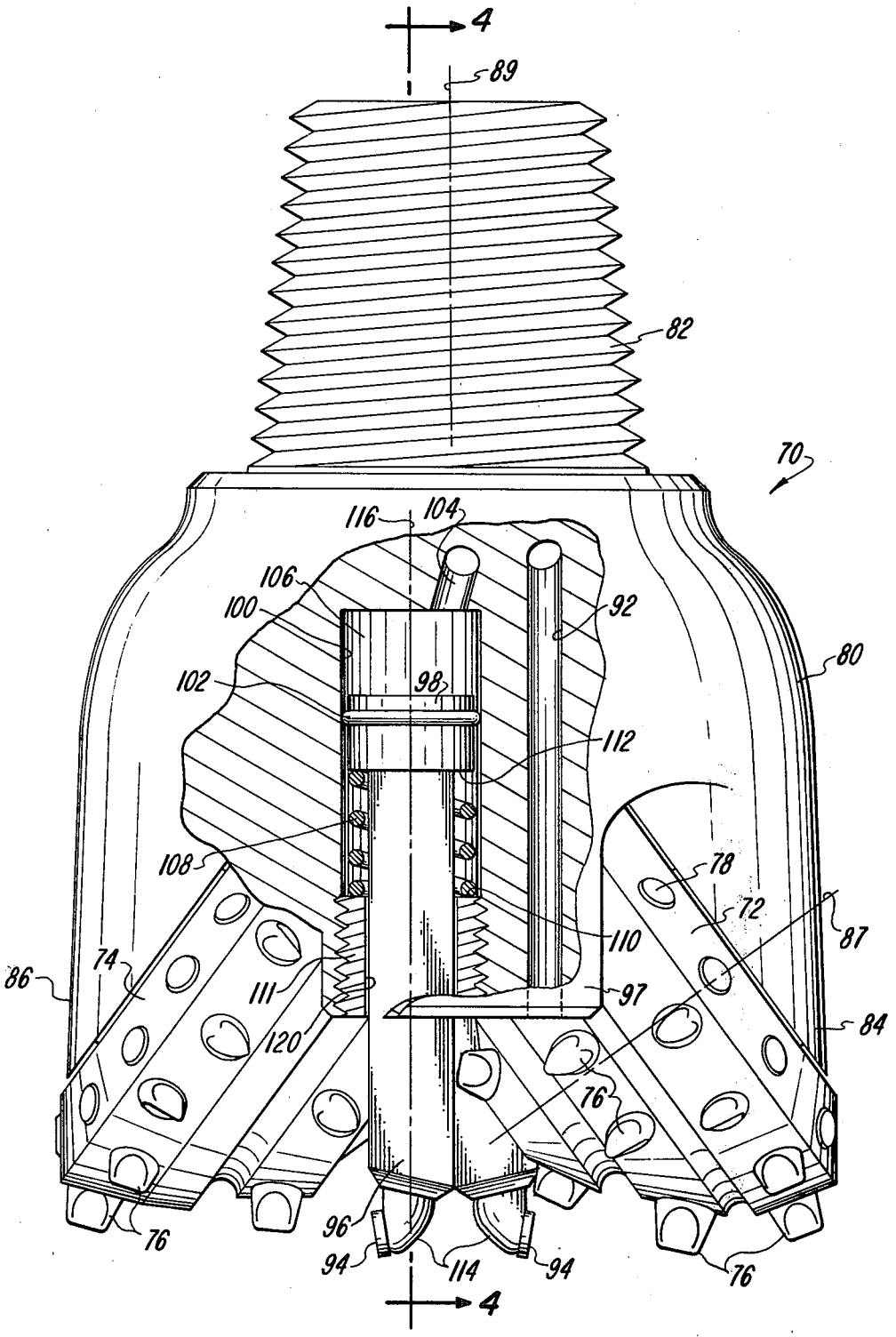
FIG. 3 is a side elevational view of a rotary drill bit embodying another form of the present invention, with a portion broken out to more specifically illustrate details of means for yieldably supporting and applying force to an abrasion cutting element thereof.
Figure 4:
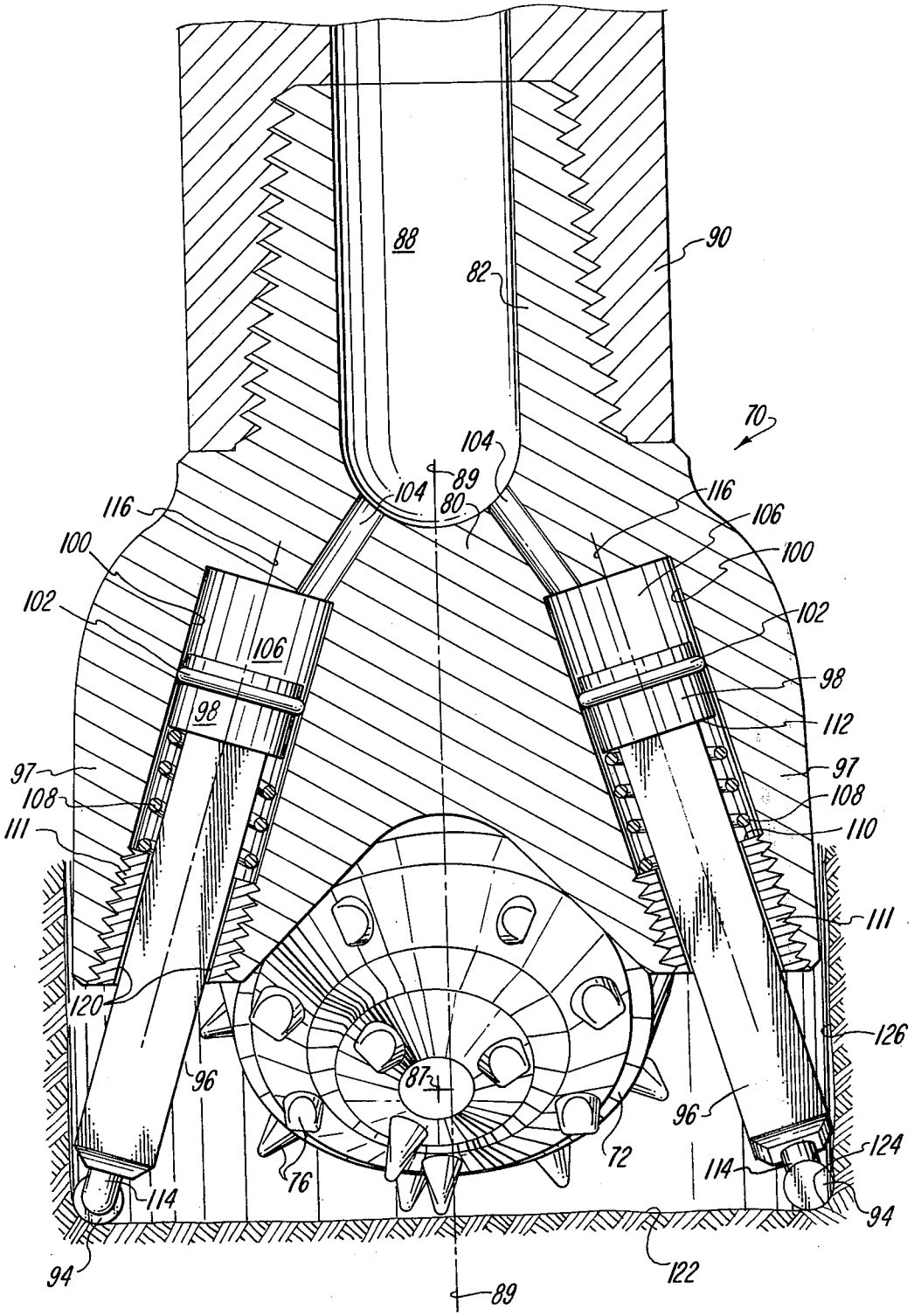
FIG. 4 is a section view taken substantially in the plane of line 4—4 of FIG. 3, with a portion of drill string pipe included in the view.

Another embodiment of the present invention shown primarily in FIGS. 3 and 4 is particularly useful in conjunction with a rotary drill bit 70 to which a plurality of conventional cone-shaped cutter wheels 72 and 74 are rotatably connected. Drill bits utilizing rotational or cone-shaped cutter wheels are well known in the art. The drill bit 70 utilizes the two cone wheels 72 and 74 to assure sufficient remaining space for incorporating the means for yieldably supporting and applying force to the abrasion cutting elements. Depending upon the particular type of rotary drill bit configuration in which the present invention is incorporated, either a number of cutter wheel members greater or lesser than the two shown can be employed.

Each of the cone wheels 72 and 74 includes a plurality of cutting elements 76 and 78 attached thereto. The cutting elements 76 will typically be the well known tungsten carbide inserts, although the cutting elements 76 may also be metallic teeth formed integrally with the cone wheels are hardened by various metallurgical techniques. The cutting elements 76 are intended to attack the earth formation in an indentor mode of attack which is obtained as a result of axial compression forces applied axially by the weight of the bit and drill string. The cutting elements 78 are optionally attached to the cone wheels and are of the abrasion type. The cutting elements 78 typically create a reaming effect on the sidewall of the borehole substantially above the position where the cutting effects from elements 76 occur. The row of cutting elements 76 extending from the cone wheel at a maximum diameter of the conical surface is known as a heel row. In offset cone wheel drill bits, the heel row of inserts 76 primarily cuts the well bore to its gage or maximum diameter. It is the heel row of cutting elements 76 that experiences significant wear as a result of cutting the well bore to gage. The wear occurs from a combination of both compression and abrasion cutting forces, because the amount of material which must be removed at the maximum diameter of the well bore is greater than the amount of material which must be removed at inner radial locations, and because the supporting sidewall of the well bore creates an increased resistance to the crushing, chipping action at the outer location of the drill face as compared to inner locations.

The cone wheels 72 and 74 are rotationally attached to a main body structure 80 of the bit 70. The body structure 80 includes an upper threaded end 82 to which the lowermost segment or length of drill pipe 84 (FIG. 4) of the drill string is threadably connected. Leg portions 84 and 86 extend downward from the body structure 80, and the cone wheels 72 and 74 are respectively connected to the leg portions 84 and 86 by the conventional bearing means rotationally positioned between a journal pin extending from each leg member and an inner opening formed within the cone wheel (none of which is specifically shown). Each of the cone wheels rotates about an axis 87 through the cone wheel and journal pin. Because the cone wheels are connected at rigid axial positions to the support body, the cutting elements on the cone wheels rotate into operative cutting contact with the earth formation at fixed operative positions relative to the body structure. No axial yielding of these cutting elements relative to the body structure is possible due to their operative connection in fixed operative positions. Preferably the bit 70 is of the offset type, meaning that each cone wheel axis 87 extends parallel to but offset or displaced from a radial reference extending through the rotational axis 89 of the bit as a whole, as shown in FIG. 4. The offset configuration is well known and secures an increased penetration rate in earth formations due to a scraping, gouging action of the cutting elements 76. A drilling fluid passageway 88 (FIG. 4) extends into the body structure 80 and aligns with the drilling fluid passageway formed in the lowermost length of drill pipe 90 of the drill string. A conduit 92 (FIG. 3) is formed in the body structure 80 and extends from the drilling fluid passageway 90 to an exterior position of the body structure. The conduit 92 defines a nozzle for expelling the wash jets of pressurized drilling fluid onto the drill face, preferably at a position slightly radially inwardly spaced from the gage corner portion and maximum diameter of the drill face.

At least one, but preferably a plurality of abrasion cutting elements 94, are operative in conjunction with the drill bit 70. Means for yieldably supporting and applying cutting force to the abrasion cutting elements 94 is also provided and takes the form of a movable mounting member 96 operatively connected to a piston 98 or other hydraulic means. Integral arm portions 97 extend from the body structure 80 in between the leg portions 84 and 86 for the purpose of retaining the yieldably supporting and force applying means of the present invention. The piston 98 moves within a piston bore 100 defined in the arm portions 97 and body structure 80. Sealing means 102 extend between the piston 98 and the piston bore 100. A conduit 104 extends through the body structure 80 to the drilling fluid passageway 88. Pressurized drilling fluid present in the drilling fluid passageway 88 is conducted or coupled through the conduit 104 into a chamber 106 defined in the piston bore 100 above each piston 98. Below each piston 98 a spring member 108 is operatively positioned between the mounting member 96 and the piston bore 100. A shoulder 110 of an insert 111 retains the spring 108 at its lowermost end, and a lower shoulder 112 of the piston 98 retains the spring at its upper end. The insert 111 is preferably threaded into a lower threaded portion of the piston bore 110. By forming the piston bore 100 and its lower threaded end of uniform diameter along its length, the piston 98 and spring 108 and the mounting member 96 can be inserted therein and held in place by threading the insert 111 into the lower threaded end of the bore. Such an arrangement allows assembly of the means for yieldably supporting and applying force to the abrasion cutting elements.

Each of the abrasion cutting elements 94 are of the conventional type. Each abrasion cutting element 94 is connected by a slug 114 to the lower end of each mounting member 96. Each mounting member 96 is preferably rectangular in cross section. A correspondingly rectangular shaped opening 120 is formed through the insert 111 to allow the mounting member 96 to move in a reciprocating manner without twisting. The mounting member 96 and piston 98 rotate with the insert 111 when the insert is threaded into the lower end of the bore 110 during assembly. The insert 111 can be staked or rigidly retained to the arm portion 97 after assembly in order to prevent the insert from rotating in the bore 100.

The bias force from spring 108 normally moves the piston 98 and the mounting member 96 and its attached abrasion cutting element 94 to a retracted nonoperative position. In the retracted position the volume of chamber 106 is diminished possibly to zero. The force from the hydraulic drilling fluid present in the drilling passageway 88 conducted to the chamber 106 overcomes the bias force of the spring 108 and moves the piston 98 in the bore 100 to extend the mounting member 96 and abrasion cutting element 94 to an operative extended position. The reciprocative movement of the elements 94, 96 and 98 is in a direction parallel to the axis 116 of the piston bore 100. The piston bore 100 is oriented to extend radially outward in an axially advancing (downward) direction.

Figure 5:
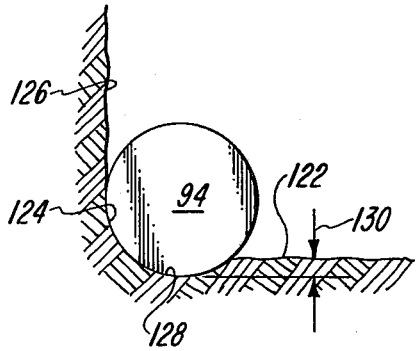
FIG. 5 is an axial section view of a gage corner portion of the earth formation and the well bore which illlustrates the cutting effects of an abrasion cutting element of the drill bit shown in FIGS. 3 and 4.

As is shown in FIGS. 4 and 5, the abrasion cutting element 94 contacts both the drill face 122 and the gage corner material or portion 124 of the well bore. As is known in the art, the gage corner portion 124 results from the offset configuration of the cone wheels. The gage corner material 124 diverges radially outward and axially upward from the drill face circumjacent the gage corner. In conventional offset multi-cone drill bits the gage corner material 124 is removed by the heel row of inserts to achieve the full diameter or gage at the sidewall portion 126 of the well bore. The sidewall portion 126 is, of course, axially above the gage corner portion 124.

The abrasion cutting elements 94 are operatively positioned on the lower end of the mounting members 96 to create an abrasion cutting effect on the gage corner material or portion 124 and on the drill face 122 at an outer radial position adjacent the gage corner, as is best shown in FIG. 5. The operative position of the abrasion cutting elements 94 to achieve these effects is determined in accordance with the geometry of the angular orientation of the movement axis 116 of the elements 96 and 98 within the arm portions 97 and in accordance with the desired maximum extent of reciprocating movement from the retracted position to the extended position of the means for yieldably supporting and applying force to the cutting element 94.

The amount of cutting force applied between the earth formation and the abrasion cutting elements is operationally determined by the pressure of the hydraulic drilling fluid in the passageway 88 at the bit 70. Of course, the surface area of the piston 98 facing into the chamber 106 is taken into consideration in converting the hydraulic pressure into cutting force. The bias force of the spring 108 is essentially negligible since the primary function of the spring 108 is to hold the yieldable supporting and force applying means in its retracted nonoperative position when non-substantial amounts of hydraulic pressure are applied to the drilling fluid in the passage 88.

Figure 6:
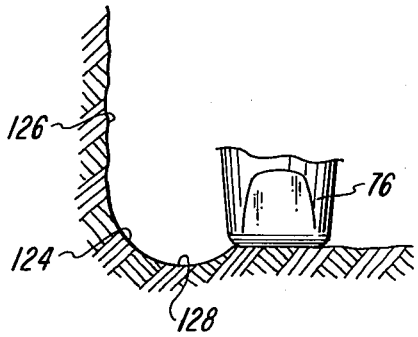
FIG. 6 is a view similar to FIG. 5 illustrating the cutting location on the drill face of the well bore created by indentor or compression cutting elements attached as the heel row to the rotary cutting wheel of the drill bit illustrated in FIGS. 3 and 4.

One significant advantage resulting from the operative position of the abrasion cutting elements 94 is that the abrasion cutting elements 94 assist the heel row of cutting elements in removing the gage corner material. The abrasion cutting elements operate in their intended drag mode and are therefore very effective in removing the gage corner material in contrast to the limited drag-type cutting effects available on the gage corner from the heel row of cutting elements 76. It is known and understood that the heel row of cutting elements on the cone cutter wheels operate primarily in the nonintended drag mode in removing the gage corner material. The undesirable results from operating a compression or indentor type cutting element, i.e. a tungsten carbide insert or hardened tooth, in the drag mode have previously been described. The result of this undesirable operation is a relatively rapid wear or disintegration of many of the cutting elements in the heel row. As an undesirable consequence, the well bore becomes undergage, thereby causing difficulty in inserting subsequent drill bits, various other drilling tools and the well casing. Also, the prior art drill bit typically fails as a result of premature failure of the heel row of cutting elements even though the other rows of cutting elements remain relatively effective. Employing the abrasion cutting element 94 in its intended drag mode of operation to assist in removing the gage corner material 124 prolongs the usable lifetime of the drill bit and the cutting element of the heel row and avoids cutting an undergage well bore. The penetration rate also increases. As can be seen from FIG. 5, the abrasion cutting elements 94 cut a depressed groove 128 to a depth represented at 130 below the lowermost extent of the drill face 122. It is also well recognized in the art that the lateral support provided by the gage corner and sidewall of the well bore increases the resistance of the earth formation to crushing and chipping by the heel row of cutting elements. FIG. 6 illustrates that the recessed groove 128 provides a relief for the heel row of inserting cutting elements 76, one of which is shown in FIG. 6, as they reach their lowermost position. The groove 128 removes the lateral support from the sidewall of the well bore and allows the heel row of cutting elements to more effectively chip and crush the earth formation. The heel row cutting element 76 shown in FIG. 6 is shown at its lowermost point of travel which is slightly inwardly spaced from the sidewall 126. As is well known in the offset bit configuration, each cutting element achieves its maximum radially outward position at a rotational position before rotating to a lowermost position. Another significant advantage is that the well bore advances or penetrates in a straighter manner because it is less susceptible to natural imbalances caused by sloping earth formations. The abrasion cutting elements 94 more effectively remove the gage corner material 124 even in sloping formations, and the gage corner material is less likely to impart a lateral imbalance to the drill bit and force it off of a straight course. If the gage corner material is not completely removed, the residual gage corner material applies lateral force to the bit thereby directing it off course. In this regard the present invention achieves an opposite effect from that described in U.S. Pat. No. 4,211,292 of the inventor herein, in which gage corner influences are intentionally created for the purpose of intentionally deviating the course of the well bore. In the prior art, one typical approach to attempting to drill straight well bores even through sloping geological formations which create potentially significant deviations is to employ a drill bit with a nonoffset configuration. U.S. Pat. No. 3,239,431 discloses one example of a drill bit highly useful for drilling straight well bores. The disadvantage of such prior art straight hole drill bits is that the non-offset configuration results in a reduced rate of penetration. The offset configuration which may be utilized in conjunction with the present invention offers well recognized substantial increases in penetration rate. It is thereby possible as a result of the present invention to drill relatively straight well bores at increased penetration rates as compared to the penetration rates of prior art drill bits for drilling straight well bores.

Another substantial advantage as a result of the present invention is that optimum cutting force can be applied to both the compression cutting elements 76 and the abrasion cutting elements 94 on the same drill bit. The axial force applied to the compression cutting elements 76 is as a result of the weight on the bit 70. The weight on the bit 70 is regulated by regulating the force on the drill string applied by the drill rig at the surface of the earth. The force on the abrasion cutting elements is regulated by the hydraulic fluid pressure of the drilling fluid within the passageway 88, and by the size of the piston 98 exposed to the hydraulic drilling fluid. The pressure of the drilling fluid within the drilling fluid passageways is regulated by means of jet nozzle orifice selection and hydraulic pumps of the drilling rig. The hydraulic fluid pressure is independent of the weight applied on the drill bit. By regulating the hydraulic fluid pressure optimum cutting force can be regulated and applied to the abrasion cutting elements and this abrasion cutting force will typically be less than the axial force applied from the drill bit through the cone wheels to the earth formation. Accordingly, the features of the present invention allow abrasion cutting elements to be used in combination with compression cutting elements on the same drill bit and to achieve the best cutting effects for each type of cutting element separate from and independent of the other. Differences in the pressure of the drilling fluid expelled from the nozzles of the drill bit do not significantly alter the efficiency by which the particle cuttings are washed away from the drill face and out of the well bore. Regulating the pressure of the drilling fluid achieves desirable control over the cutting force on the abrasion cutting elements without altering the other normal cutting effects of the bit.

Other significant advantages are that the abrasion cutting elements are protected from intermittent shock and locally concentrated loads and from damage during tripping. If the magnitude of an intermittent shock or concentrated load exceeds the hydraulic force applied on the piston 98, the mounting member 96 will move slightly toward its retracted position and thereby yield against the increased load. In this manner, the abrasion cutting elements are protected from premature failure from shock and concentrated loads. The abrasion cutting elements are positioned in the retracted position when the drilling fluid in the passageway 88 is not pressurized. This is very important during tripping. During the relatively rapid axial movement of the drill bit during tripping the elements of the drill bit may slightly deflect off of the sidewalls of the well bore. The deflection force may be significant particularly if one of the abrasion cutting elements is directly contacted. The abrasion cutting elements, of course, are susceptible to breakage from such forces. By withdrawing the abrasion cutting elements radially inward as a result of moving them to the retracted position, the abrasion cutting elements are less susceptible to damage during tripping.

Figure 7:
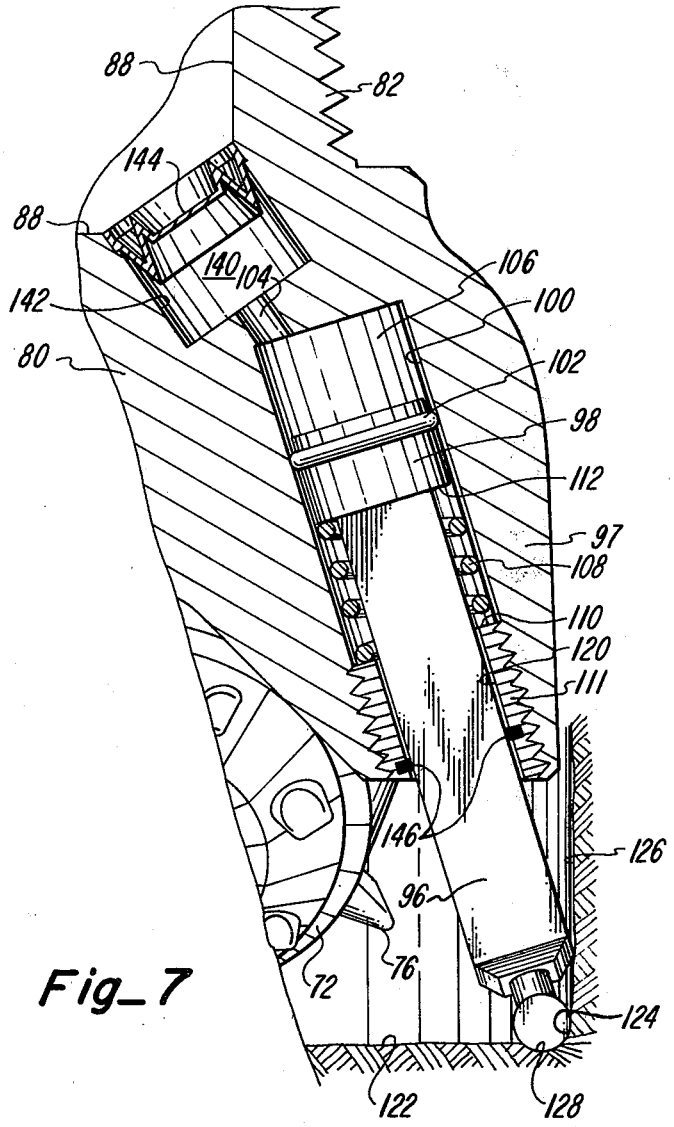
FIG. 7 is a view similar to a portion of FIG. 4 illustrating another embodiment of the means for yieldably supporting and applying force to the abrasion cutting elements.

FIG. 7 illustrates another embodiment of the yieldably supporting and force applying means of the present invention in which the piston 98 and piston bore 100 are isolated from the effects of the drilling fluid and the abrasive particles typically carried by the drilling fluid. Instead of extending the conduit 104 directly to the drilling fluid passageway 88, the conduit 104 extends into a hydraulic fluid reservoir 140 as shown in FIG. 7. The hydraulic reservoir 140 is defined by an enlarged bore 142 extending into the body structure 80 from the drilling fluid passageway 88. A flexible bellows member 144 is operatively positioned and sealed to the mouth of the bore 142 at the drilling fluid passageway 88. The bellows member isolates the fluid in the reservoir 140 from the drilling fluid in the passageway 88. A seal means 146 is positioned in the insert 111 and contacts the sidewalls of the mounting member 96. The seal means 146 creates a barrier to the ingress of drilling fluid and particle cuttings through the opening 120 in the insert 111. Thus the piston 98 is sealed from the drilling fluid by the flexible bellows member 144 and the sealing means 146. The reservoir 140, the conduit 104 and the chamber 106 are filled with hydraulic fluid.

The embodiment shown in FIG. 7 operates in a related manner as the embodiment shown in FIGS. 3 and 4. When the drilling fluid in the passageway 88 is pressurized, the flexible bellows member 144 collapses into the reservoir 140 and forces hydraulic fluid into the chamber 106. The piston 98 and mounting member 96 are moved toward the extended position. When the pressure on the drilling fluid in the passageway 88 is relieved, the bias force from spring 108 moves the piston 98 upward into the chamber 106 and forces hydraulic fluid back into the reservoir 140. In all other respects, the advantages, operation and features of the embodiment of the yieldable supporting and force applying means shown in FIG. 7 is similar to that previously described in conjunction with FIGS. 3 to 6.

The embodiments, systems, processes and improvements of the present invention have been shown and described with a degree of specificity. It should be understood, however, that the specificity of the description has been made by way of preferred examples and that the invention is defined by the scope of the appended claims.

What is claimed is:

1. A rotary drill bit for drilling a well bore in an earth formation, which includes a body structure, and at least one cutter wheel rotationally connected to the body structure at a fixed operative position, and a first predetermined plurality of compression cutting elements connected to the cutter wheel and rotatable into contact with a drill face of the earth formation in primarily an indentor mode of attack, a second predetermined or heel portion of compression cutting elements connected to the cutter wheel, said heel portion of compression cutting elements movable into contact with a gage corner of the earth formation in a significant degree of drag mode of attack when said cutter wheel rotates, and at least one abrasion cutting element operatively retained for contact with the earth formation in a drag mode of cutting contact, and an improvement in combination therewith for decreasing the adverse wear effects on the heel portion of the compression cutting elements due to adverse contact with the gage corner in the drag mode of attack, comprising:

means connecting the abrasion cutting element to the body structure for operative reciprocative movement between an extended position and a retracted position and wherein in the extended position the abrasion cutting elements contacts substantially only the gage corner of the earth formation in a drag mode of attack to reduce the amount of earth material to be cut by the heel portion of the compression cutting elements and allowing the drill face to be cut substantially only by the first portion of the compression cutting element.

2. A rotary drill bit for drilling a well bore in an earth formation, which includes a body structure, and at least one cutter wheel rotationally connected to the body structure at a fixed operative position, and a plurality of compression cutting elements connected to the cutter wheel and rotatable into contact with the earth formation in primarily an indentor mode of cutting attack, and at least one abrasion cutting element operatively retained for contact with the earth formation in a drag mode of cutting contact, and an improvement in combination therewith, comprising:

means connecting the abrasion cutting element to the body structure for operative reciprocative movement between a retracted position and an extended position, the extended position operatively locating the abrasion cutting element downwardly and radially outwardly with respect to the retracted position to assist the indentor cutting elements in advancing the well bore at a drill face of the well bore.

3. A rotary drill bit for drilling a well bore in an earth formation, which includes a body structure, and at least one cutter wheel rotationally connected to the body structure at a fixed operative position, and a plurality of compression cutting elements connected to the cutter wheel and rotatable into contact with the earth formation in primarily an indentor mode of cutting attack, and at least one abrasion cutting element operatively retained for contact with the earth formation in a drag mode of cutting contact, and an improvement in combination therewith, comprising:

means connecting the abrasion cutting element to the body structure for operative reciprocative movement between an extended position and a retracted position, and wherein in its extended position the abrasion cutting element operatively cuts a circular recessed groove into the earth formation at a drill face of the well bore which is circumjacent a side wall of the well bore, and the groove extends to an axial depth greater than the depth of the remaining earth formation at the drill face spaced radially inward from the groove.

4. A drill bit as recited in claims 1, 2 or 3 wherein the abrasion cutting element comprises diamond material.

5. A drill bit as recited in claims 1 or 3 wherein the retracted position is radially inwardly spaced from the extended position.

6. A drill bit as recited in claims 1, 2 or 3 wherein said means connecting the abrasion cutting element for operative reciprocative movement further comprises:

hydraulic means for operatively moving the abrasion cutting element from the retracted position to the extended position and for regulating the amount of force by which the abrasion cutting element is urged into the earth formation substantially independently of the amount of force by which the compression cutting elements connected to the cutter wheel are urged into the earth formation.

7. A drill bit as recited in claims 1, 2 or 3 wherein each cutter wheel is attached to the drill bit in an offset manner.

8. A drill bit as recited in claims 1 or 2 wherein:

said means connecting the abrasion cutting element for operative reciprocative movement operatively positions the abrasion cutting element in its extended position for cutting a recessed groove at the outer circumference of the drill face which extends to an axial depth greater than the depth of the remaining earth formation at the drill face spaced radially inward from the groove.

9. A drill bit as recited in claims 1, 2 or 3, which further includes a drilling fluid passageway extending to the body structure, and said improvement further comprises:

hydraulic means for operatively moving the abrasion cutting element from the retracted position to the extended position, and means coupling fluid pressure at the drill fluid passageway to said hydraulic means to operate said hydraulic means in response to predetermined fluid pressure within the drilling fluid passageway.

10. A drill bit as recited in claim 9 wherein said means connecting the abrasion cutting element for operative reciprocative movement further comprises:

a mounting member moveably connected to the body structure, means defining a piston bore, a piston retained for reciprocating movement within the piston bore and operatively connected to move said mounting member, a hydraulic chamber defined by a space within the piston bore unoccupied by the piston, and means conducting fluid into the hydraulic chamber.

11. A drill bit as recited in claim 10 wherein said means conducting fluid into the hydraulic chamber comprises:

a conduit in fluid communication between the drilling fluid passageway and the hydraulic chamber.

12. A drill bit as recited in claim 10 wherein said means conducting fluid into the hydraulic chamber further comprises:

a hydraulic reservoir formed in the body structure, a flexible bellows member operatively positioned in fluid isolating relationship between the hydraulic reservoir and the drilling fluid passageway, and means for conducting fluid between the hydraulic reservoir and the hydraulic chamber.

13. A rotary drill bit for drilling a well bore in an earth formation, which includes a body structure, and at least one cutter wheel rotationally connected to the body structure at a fixed operative position, and a plurality of compression cutting elements connected to the cutter wheel and rotatable into contact with the earth formation in primarily an indentor mode of cutting attack, and at least one abrasion cutting element operatively retained for contact with the earth formation in a drag mode of cutting contact, a drilling fluid passageway extending to the body structure, and an improvement in combination therewith, comprising:

means connecting the abrasion cutting element to the body structure for operative reciprocative movement between an extended position and a retracted position which is radially inwardly spaced from the extended position;

hydraulic means for operatively moving the abrasion cutting element from the retracted position to the extended position, said hydraulic means including a piston bore within the body structure of said drill bit, a piston retained for reciprocating movement within the piston bore and operatively connected to move said abrasion cutting element, and a hydraulic chamber defined by a space within the piston bore unoccupied by the piston;

a hydraulic reservoir formed in the body structure of said drill bit;

means conducting fluid between the hydraulic reservoir and the hydraulic chamber; and a flexible bellows member operatively positioned in fluid isolating and pressure transferring relationship between the drilling fluid passageway and the hydraulic reservoir.

14. A rotary drill bit for drilling a well bore in an earth formation, which includes a body structure, and at least one cutter wheel rotationally connected to the body structure at a fixed operative position, and a plurality of compression cutting elements connected to the cutter wheel and rotatable into contact with the earth formation in primarily an indentor mode of cutting attack, and at least one abrasion cutting element operatively retained for contact with the earth formation in a drag mode of cutting contact, and an improvement in combination therewith, comprising:

means connecting the abrasion cutting element to the body structure for operative reciprocative movement between an extended position wherein the abrasion cutting element is operative to assist the indentor cutting elements in advancing the well bore at a drill face of the well bore and a retracted position which is radially inwardly spaced from the extended position, said means connecting the abrasion cutting element for operative reciprocative movement operatively positions the abrasion cutting element in its extended position for cutting a recessed groove at the outer circumference of the drill face which extends to an axial depth greater than the depth of the remaining earth formation at the drill face spaced radially inward from the groove.

* * * * *